US005547529A

United States Patent [19]

Woolf

[11] Patent Number: 5,547,529

[45] Date of Patent: Aug. 20, 1996

[54] PROCESS FOR FABRICATING FALSE EYELASH SYSTEM

[76] Inventor: David L. Woolf, c/o Yongho Han, 8 Clearmeadow Ct., Woodbury, N.Y. 11797

[21] Appl. No.: 383,943

[22] Filed: Feb. 6, 1995

[51] Int. Cl.[6] ..... A41G 5/02

[52] U.S. Cl. ..... 156/61; 132/53; 132/56; 132/201; 156/256; 156/267; 446/393

[58] Field of Search ..... 132/53, 56, 201; 156/61, 256, 267; 446/393

[56] References Cited

U.S. PATENT DOCUMENTS

| | | | |
|---|---|---|---|
| 1,450,259 | 4/1923 | Nessler | 132/56 |
| 3,032,042 | 5/1962 | Meehan | 132/56 |
| 3,362,417 | 1/1968 | Glaser | 132/201 |
| 3,447,540 | 6/1969 | Osher | 132/201 |
| 3,900,038 | 8/1975 | Masters | 132/201 |
| 4,299,242 | 11/1981 | Choe | 132/53 |

OTHER PUBLICATIONS

Beauty's Biggest Bafflers by Christian Wright Allure, Jun. 1994 p. 128.

*Primary Examiner*—Jeff H. Aftergut
*Attorney, Agent, or Firm*—Richard L. Miller, P. E. Registered Patent Agent

[57] ABSTRACT

The invention is a false eyelash system, for producing unknotted clusters of false eyelashes from long fibers. A plurality of long fibers are knotted around a main string with a preliminary knot. The long fibers are trimmed a distance away from the main string that corresponds to a desired eyelash length. Cement is applied to the preliminary knot and discernible distance therefrom to form a cement clot. The preliminary knot is removed by cutting through the cement clot to form unknotted clusters of false eyelashes.

4 Claims, 1 Drawing Sheet

PROCESS FOR FABRICATING FALSE EYELASH SYSTEM

BACKGROUND OF THE INVENTION

The invention relates to false eyelash system. More particularly, the invention relates to a system of false eyelashes in which a cluster is not attached with a knot.

False eyelashes have been in use for over twenty years. They are typically inserted alongside real eyelashes, by first applying a little glue to a cluster. Once the false eyelashes are in place, mascara is used to blend the real and false eyelashes together.

Women wear false eyelashes day and night. However, continually wearing conventional false eyelashes can be quite uncomfortable. Conventional false eyelashes have a knot at the root of each cluster. At times, the knot will makes the presence of the eyelashes known to the wearer every time she blinks.

While these units may be suitable for the particular purpose employed, or for general use, they would not be as suitable for the purposes of the present invention as disclosed hereafter.

SUMMARY OF THE INVENTION

It is an object of the invention to produce false eyelashes that may be comfortably worn, by eliminating the knot commonly present in each cluster.

It is another object of the invention to produce false eyelashes in an inexpensive and efficient manner.

The invention is a false eyelash system, for producing unknotted clusters of false eyelashes from long fibers. A plurality of long fibers are knotted around a main string with a preliminary knot. The long fibers are trimmed a distance away from the main string that corresponds to a desired eyelash length. Cement is applied to the preliminary knot and discernible distance therefrom to form a cement clot. The preliminary knot is removed by cutting through the cement clot to form unknotted clusters of false eyelashes.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
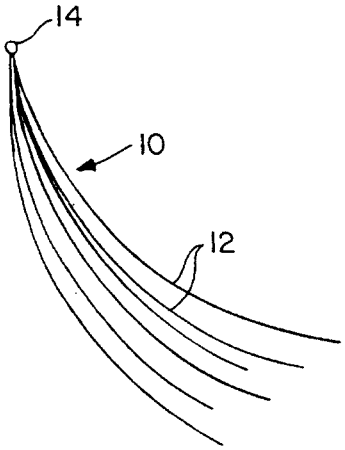
FIG. 1 PRIOR ART
FIG. 1 is an enlarged diagrammatic view of typical prior art.

FIG. 1 illustrates a conventional knotted cluster of false eyelashes 10. The conventional knotted cluster has a plurality of fibers 12. The fibers 12 are joined at one end with a knot 14.

Figure 2:
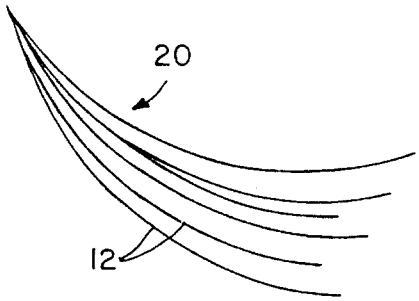
FIG. 2 is an enlarged diagrammatic view of the instant invention.

FIG. 2 illustrates an unknotted cluster of false eyelashes 20. The unknotted cluster 20 comprises a plurality of fibers 12, which are joined together with glue.

Figure 3:
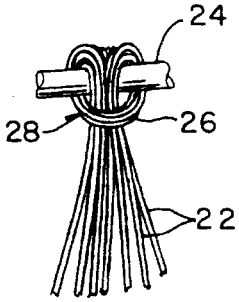
FIG. 3 is an enlarged diagrammatic view illustrating the hair fibers being assembled to a main string.
Figure 4:
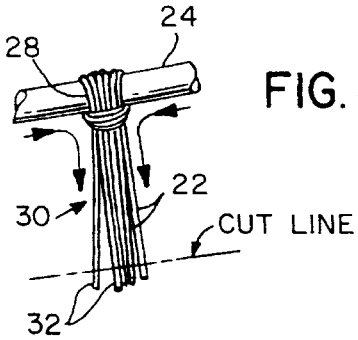
FIG. 4 is an enlarged view illustrating the hair fibers in close proximity to each other and pulled tight on the main string.

FIG. 3 illustrates a beginning step in preparation of the unknotted cluster 20. A plurality of long fibers 22 are knotted to a main string 24.

The preferred method of knotting the long fibers 22 is by kinking the long fibers 22 at their center, creating a loop 26. The loop 26 is held against the main string 24, creating an opening between the loop 26 and the main string 24. The remainder of the long fibers 22 is directed around the main string 24 and then through the loop 26. The long fibers are pulled tight to make a preliminary knot 28 around the main string 24.

After the long fibers 22 are knotted to the main string 24, the long fibers 22 are cut at a distance from the preliminary knot 28 corresponding to a desired false eyelash length. The direction of the cut is transverse to the long fibers 22. The cut divides the long fibers into a short fiber cluster 30 and excess fibers 32. The excess fibers 32 are either discarded or in the alternative grouped together to repeat the knotting process to the main string 24 a short distance away from the preliminary knot 28 of the short fiber cluster 30.

Figure 5:
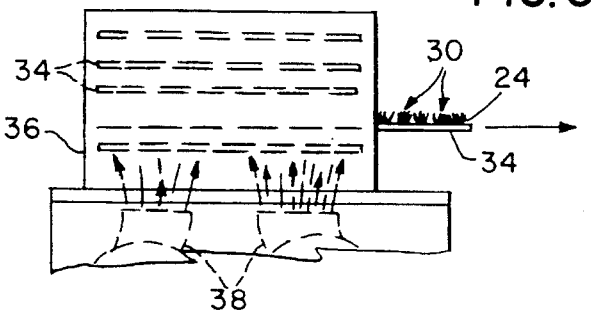
FIG. 5 is a diagrammatic view illustrating a typical oven with removal trays containing hair fibers.

After a plurality of short fiber clusters 30 are attached to the main string 24, the main string is laid across a tray 34. As illustrated in FIG. 5, the trays are placed in an oven 36, having a pair of heat sources 38, which emanate heat. The heat makes the short fiber clusters 30 curl.

Figure 6:
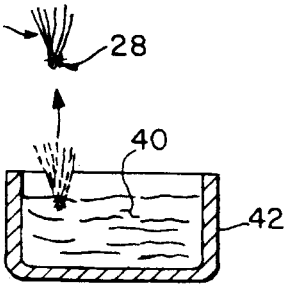
FIG. 6 and FIG. 6A are diagrammatic views illustrating typical methods of applying cement to the hair fibers.
Figure 7:
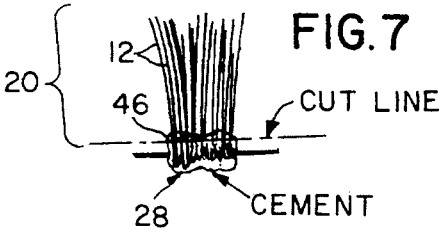
FIG. 7 is an enlarged diagrammatic view of the final step of cutting the hair fibers free from the knot and thereby forming the instant invention.
Figure 6A:
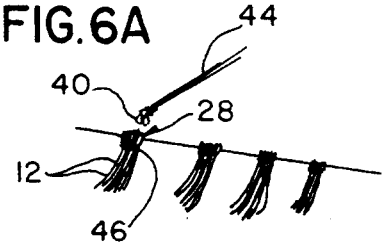

After the short fiber clusters 30 have curled sufficiently, the heat is removed, and the next step is to add cement 40 at the preliminary knot 28 of each short fiber cluster 30. As illustrated in FIG. 6, this may be accomplished by dipping the preliminary knot 28 end of the short fiber cluster 30 into a cement bath 42 filled with cement 40. The cement may also be dabbed onto each preliminary knot 28 with a pick or swab 44 soaked with cement 40, as illustrated in FIG. 6A. In either cementing technique, the cement 40 must be applied so that it joins the fibers 12 together a short but discernible distance away from the preliminary knot 28, forming a cement clot 46.

Once the cement dries, the final stage involves removing the preliminary knot 28 to create the unknotted cluster 20 as in FIG 2. Since the cement connects the fibers 12 of the short fiber cluster 30 together, the preliminary knot 28 may be removed by cutting the fibers 12 traverse to the fibers 12, but extending through the cement clot 46. Care is taken to ensure that the fibers 12 are still joined by the cement clot 46 once the preliminary knot is cut off.

In conclusion, a system is presented for producing false eyelashes that are joined into a cluster without the need for a bulky, uncomfortable knot.

What is claimed is:

1. A false eyelash method, for producing unknotted clusters of false eyelashes having a desired eyelash length, using a plurality of long fibers, a main string, and cement, comprising the steps of:

a) knotting the long fibers onto the main string, forming a preliminary knot at the main string;

b) trimming the long fibers transverse to the long fibers at a distance from the preliminary knot equal to the desired eyelash length to create a short fiber cluster;

c) cementing the short fiber cluster at the preliminary knot, creating a cement clot that attaches the fibers for a discernible distance away from the preliminary knot; and d) creating the unknotted cluster by cutting through the cement clot to remove the preliminary knot, while assuring that the fibers are still attached together by the cement clot; wherein the step of cementing the short fiber clusters is preceded by the step of: heating the short fiber clusters to curl the fibers by laying the main string across a tray and placing the tray in an oven having a pair of heat sources which emanate heat.

2. The method as recited in claim 1, wherein a plurality of short fiber clusters are knotted onto the main string.

3. The method as recited in claim 2, wherein the step of cementing is performed by dabbing cement onto the preliminary knot with a swab soaked with cement.

4. The method as recited in claim 2, wherein the step of cementing is performed by dipping the short fiber cluster into a cement bath.

* * * * *